US005454324A

United States Patent [19]

Larmignat et al.

[11] Patent Number: 5,454,324

[45] Date of Patent: Oct. 3, 1995

[54] SMOKE-FORMING MUNITION

[75] Inventors: Daniel A. Larmignat, Plaimpied; Jean-Pierre Le Pezennec, Bourges, both of France

[73] Assignee: Giat Industries, Versailles, France

[21] Appl. No.: 139,797

[22] Filed: Oct. 22, 1993

[30] Foreign Application Priority Data

Oct. 23, 1992 [FR] France ..... 92 12697

[51] Int. Cl.[6] ..... C06D 3/00

[52] U.S. Cl. ..... 102/334; 102/351; 102/342; 102/357; 102/360; 102/531

[58] Field of Search ..... 102/334, 342, 102/351, 352, 357, 360, 531

[56] References Cited

U.S. PATENT DOCUMENTS

| | | | |
|---|---|---|---|
| 3,575,111 | 4/1971 | Richardson | 102/37.8 |
| 3,983,817 | 10/1976 | Tucker | 102/41 |
| 3,993,838 | 11/1976 | Heytmeijer et al. | 428/403 |
| 4,053,433 | 10/1977 | Lee | 252/408 |
| 4,291,029 | 9/1981 | Keeler | 102/334 |
| 4,549,489 | 10/1985 | Billard et al. | 102/505 |
| 4,586,439 | 5/1986 | Wrana | 102/438 |
| 4,621,579 | 11/1986 | Badura et al. | 102/334 |
| 4,651,648 | 3/1987 | Alon | 102/387 |
| 4,791,870 | 12/1988 | Simpson | 102/342 |
| 4,969,398 | 11/1990 | Lundwall | 102/293 |
| 5,337,671 | 8/1994 | Varmo | 102/334 |

FOREIGN PATENT DOCUMENTS

| | | |
|---|---|---|
| 2280876 | 2/1976 | France . |
| 2560186 | 8/1985 | France . |
| 2612287 | 9/1988 | France . |
| 2624113 | 6/1989 | France . |

*Primary Examiner*—Peter A. Nelson
*Attorney, Agent, or Firm*—Oliff & Berridge

[57] ABSTRACT

A munition has at least two smoke pots disposed in a casing and ejected outside the casing by an ejection composition. Each pot has an axial channel, and the axial channels are aligned so as to constitute an ignition channel of the smoke pots, ignition being ensured by the ejection composition. The munition has a temporary axial link between the two smoke pots when they are ejected and on their trajectory.

20 Claims, 4 Drawing Sheets

SMOKE-FORMING MUNITION

BACKGROUND OF THE INVENTION

The field of the present invention is that of smoke-forming munitions.

Smoke-forming munitions having several pots of smoke-generating pyrotechnic composition disposed in the casing of an artillery shell are known. At a point in time determined by a timer rocket, the shell ejects the pots outside the casing on a trajectory. A pyrotechnic charge causes the pots to be both ejected and ignited. The pots strike the ground and generate a smoke screen opaque to radiation in the visible and/or infrared range, depending on the nature of the pyrotechnic composition contained in the pots.

Smoke-forming munitions having pots of pyrotechnic composition ejected out of a casing integral with a vehicle or a fixed structure are also known.

French Patent Appln. No. 8703415 (French Patent No. 2,612,287) describes such a munition, which allows both 1) a powder that quickly masks infrared radiation and 2) smoke-forming pots that generate an infrared-opaque screen, which is intended to remain durably in place, to be dispersed.

The above-described munitions have the disadvantage of not allowing good placement of the smoke-forming pots on the ground.

To create an efficient smoke screen, the pots forming the screen should not be too remote from each other (a relative distance of a few meters to a few tens of meters, depending on the volumes of the smoke pots) so that individual screens created by the pots overlap to form a larger screen.

Smoke pots ejected outside the body of a shell follow trajectories that are difficult to control and that depend on the altitude at which ejection is ordered. Hence, the pots arrive on the ground at relative distances that vary greatly from one shot to another, giving a random quality to the smoke screen obtained.

Leakage of ejection gases may also occur at the interface between two adjacent pots. Upon ejection, this leakage causes uncontrollable pot spacing.

Likewise, the munition of French Patent Appln. No. 8703415 keeps two smoke pots and a cartridge, containing masking powder, attached by a rod. A separation charge breaks the rod when the pots have been ejected outside the casing. After the rod breaks, however, the two smoke pots are no longer joined together and will strike the ground too far apart for the screen to be effective.

It is also very difficult to control the braking thrust produced by the separation charge in the smoke pots. This thrust causes relatively wide spacing between one munition and another, over the distances between the vehicle or structure to be screened and the smoke screen obtained.

SUMMARY OF THE INVENTION

To remedy these and other drawbacks, a munition according to the invention includes at least two smoke pots that are ejected outside a casing of the munition. A temporary axial link between the smoke pots is maintained after ejection, allowing the relative distance between the smoke pots to be controlled. Smoke screens produced by the pots overlap, creating an effective overall smoke screen.

BRIEF DESCRIPTION OF THE DRAWINGS

The invention will be better understood by reading the detailed description of preferred embodiments, which refers to the attached drawings, wherein.

DETAILED DESCRIPTION OF PREFERRED EMBODIMENTS

A munition of the smoke-forming type according to the invention includes at least two smoke pots disposed in a casing and ejected outside the casing, preferably by an ejection composition. Each pot preferably includes an axial channel, the axial channels being aligned so as to constitute an ignition channel of the smoke pots. The munition includes means to ensure a temporary axial link between the two smoke pots when they are ejected and on their trajectory. Such an arrangement allows the relative distance between the two pots after they strike the ground to be controlled.

Preferably, the link includes a substantially cylindrical ring, which penetrates into the axial channels of the smoke pots through holes provided in the cartridges of each of the pots. The ring preferably has an outside diameter less than that of the axial channel and tightly fits in the holes provided in the cartridges. The ring promotes axial linkage upon ejection, but does not prevent separation of the pots when they strike the ground. It also ensures a seal for the ejection gases at the interface between two adjacent pots. The ring may have a collar pinched between the mutually contacting surfaces of the smoke pots and can penetrate into each axial channel for a length substantially equal to the outside diameter of the ring. Such provisions contribute to a good seal. According to another characteristic, the bore diameter of the ring increases regularly from a median zone to each end. The ring can be made of a natural or synthetic polymer material.

According to another embodiment of the invention, in which the smoke pots generate a cloud of smoke opaque to infrared radiation, the munition also has, forward of the casing in the ejection direction, a housing containing a dispersible powder charge that is intended to provide instant masking of infrared radiation. The munition includes a spring disposed between the housing containing the powder charge and the smoke pots, which spring brakes the smoke pots by means of the housing when they are ejected outside the casing. Such an arrangement allows the braking forces communicated to the smoke pots by the housing containing the dispersible powder charge to be controlled. According to other characteristics, the spring may have a tapered shape and be made integral with a smoke pot by means of a link.

Figure 1:
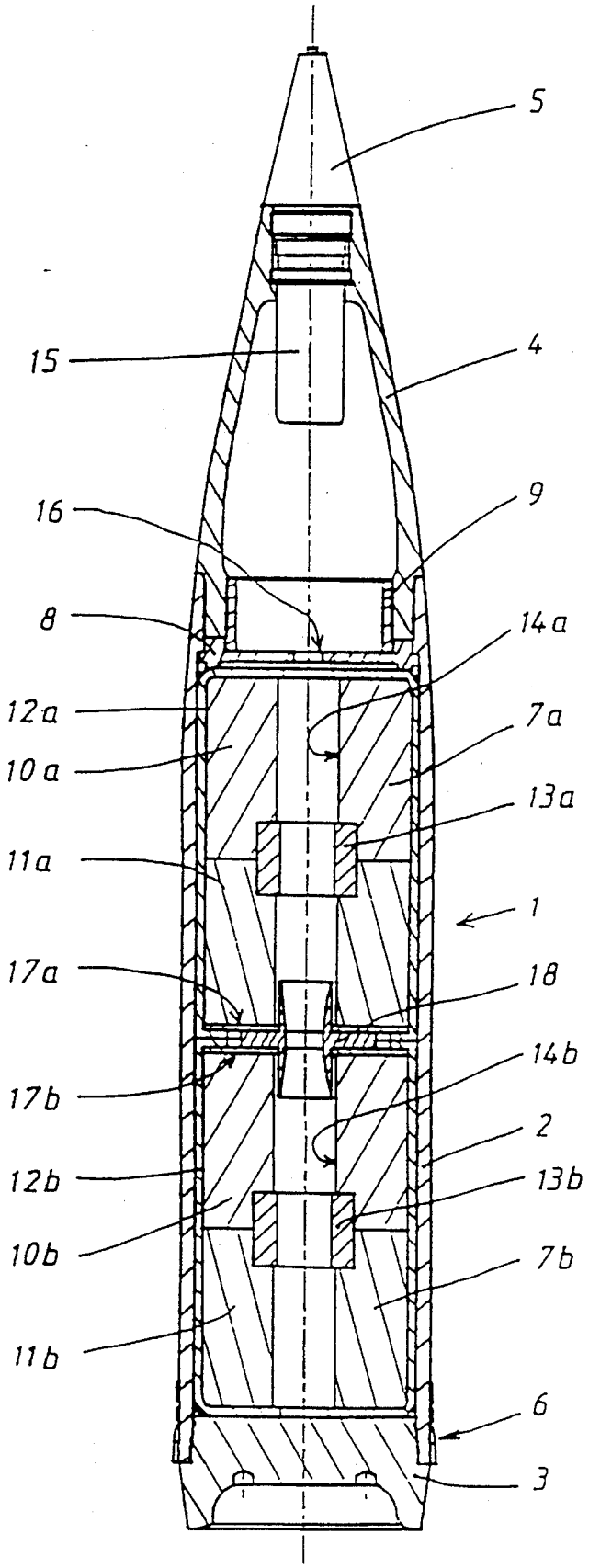
FIG. 1 show an axial-section, schematic view of a smoke shell according to an embodiment of the invention.

FIG. 1 shows a munition according to an embodiment of the invention. Munition 1 is a carrier smoke shell including a cylindrical casing 2, closed at one of its ends by threaded base 3 and at the other end by threaded nose 4, and preferably carrying timer rocket 5. Casing 2 also preferably has band 6 at its rear part to provide a seal in a known fashion upon firing from the barrel of a weapon (not shown).

Casing 2 contains two pots 7*a*, 7*b* of a smoke-forming pyrotechnic composition. Pots 7*a*, 7*b* constitute a stack, which is held axially at one end by base 2 and at the other end by piston 8. Threaded adjusting ring 9 is preferably screwed to an internal screw thread of nose 4 so that piston 8 can be applied against the stack of pots 7*a*, 7*b* to take up axial play.

The composition placed in pots 7*a* and 7*b* may be, for example, a smoke-forming composition opaque to visible and infrared radiation, of the type described in French Patent Appln. No. 8213054 (French Patent No. 2,560,186). This composition is shaped, by compression or casting, into blocks 10*a*, 11*a* for pot 7*a*, and blocks 10*b*, 11*b* for pot 7*b*. Blocks 10*a*, 10*b* and 11*a*, 11*b* are placed in metal cartridges 12*a* (for pot 7*a*) and 12*b* (for pot 7*b*), respectively.

Annular ignition tablets 13*a*, 13*b* of an igniter composition of known type, for example, an oxidizer-reducer-binder mixture, are accommodated between blocks 10*a*, 11*a* of smoke pot 7*a* and between blocks 10*b*, 11*b* of smoke pot 7*b*. Pots 7*a*, 7*b* have axial channels 14*a*, 14*b*, which allow tablets 13*a*, 13*b* to be ignited by the gases generated by ejection composition 15, itself ignited by rocket 5. Channels 14*a*, 14*b* are preferably aligned axially and preferably each have an axis in common with the longitudinal axis of munition 1. The gases reach axial channels 14*a*, 14*b* through opening 16 provided in piston 8.

Pots 7*a*, 7*b* are closed by lids 17*a*, 17*b*, each provided with an axial hole, and each lid 17*a*, 17*b* is held in place by an annular crimp of the corresponding cartridge 12*a*, 12*b*.

Ring 18, shown in detail in FIGS. 4*a*–4*b*, holds smoke pots 7*a*, 7*b* axially. Ring 18 has an outer cylindrical surface 19 whose diameter d is less than that of axial channel 14 but greater than that of the holes in lids 17*a*, 17*b*. Thus, cylindrical surface 19 is held tightly in the holes of lids 17*a*, 17*b*.

Collar 20, located at the median part of ring 18, is pinched between lids 17*a*, 17*b* of smoke pots 7*a*, 7*b*. Its thickness is essentially twice that of either cartridge 12*a*, 12*b*. Collar 20 allows proper positioning of ring 18 relative to axial channels 14*a*, 14*b*, thus ensuring good coaxiality of ring 18 and channels 14*a*, 14*b*. The diameter D of collar 20 is preferably greater than twice the diameter d of cylindrical surface 19.

Ring 18 penetrates inside each axial channel 14*a*, 14*b* for a length L, which is preferably equal to the diameter d of the cylindrical surface of ring 18. The sufficient penetration length L inside each channel 14*a*, 14*b*, the tight fit between each cartridge 12*a*, 12*b* and ring 18, and the presence of collar 20 contribute to ensuring gas-tightness of ejection composition 15 at the junction between the two pots 7*a*, 7*b*. Penetration of ring 18 into each axial channel 14*a*, 14*b* also increases tightness by favoring axial flow of the gases.

The bore of ring 18 has a cylindrical part 22 disposed at the median zone of ring 18 and having a length essentially equal to the thickness of collar 20. The bore of ring 18 also has two conical portions 21*a*, 21*b*, which extend on either side of cylindrical part 22 toward the ends of ring 18. The inside diameter of the bore is minimal at cylindrical part 22. This bore shape facilitates industrial manufacture of the ring by molding.

Ring 18 is preferably made of a natural polymer, such as rubber, a synthetic polymer, such as silicone or polyvinyl chloride, or a polyamide.

Munition 1 operates as follows:

At a point in time preset before firing, timer rocket 5 ignites ejection composition 15. The pressure of the gases generated by ejection composition 15 pushes piston 8, shearing the link between casing 2 and base 3, then ejecting base 3, and then ejecting the assembly composed of smoke pots 7*a*, 7*b*.

At the same time, the gases pass through opening 16 in piston 8 and flow into the ignition channel constituted by the two axial channels 14*a*, 14*b*. The gases trigger ignition tablets 13*a*, 13*b*. Ring 18 prevents the gases from penetrating between pots 7*a*, 7*b*, and, therefore, pots 7*a*, 7*b* are ejected together outside casing 2 and stay together as they fall.

The impact with a destination, such as the ground, is sufficiently violent to cause the two pots to separate. Even after separation and any rebounding, however, the maximum distance between pots 7*a*, 7*b* will not exceed 50 meters, for a 155 mm caliber munition, ensuring overlap between the smoke screens generated by pots 7*a*, 7*b*.

Figure 2:
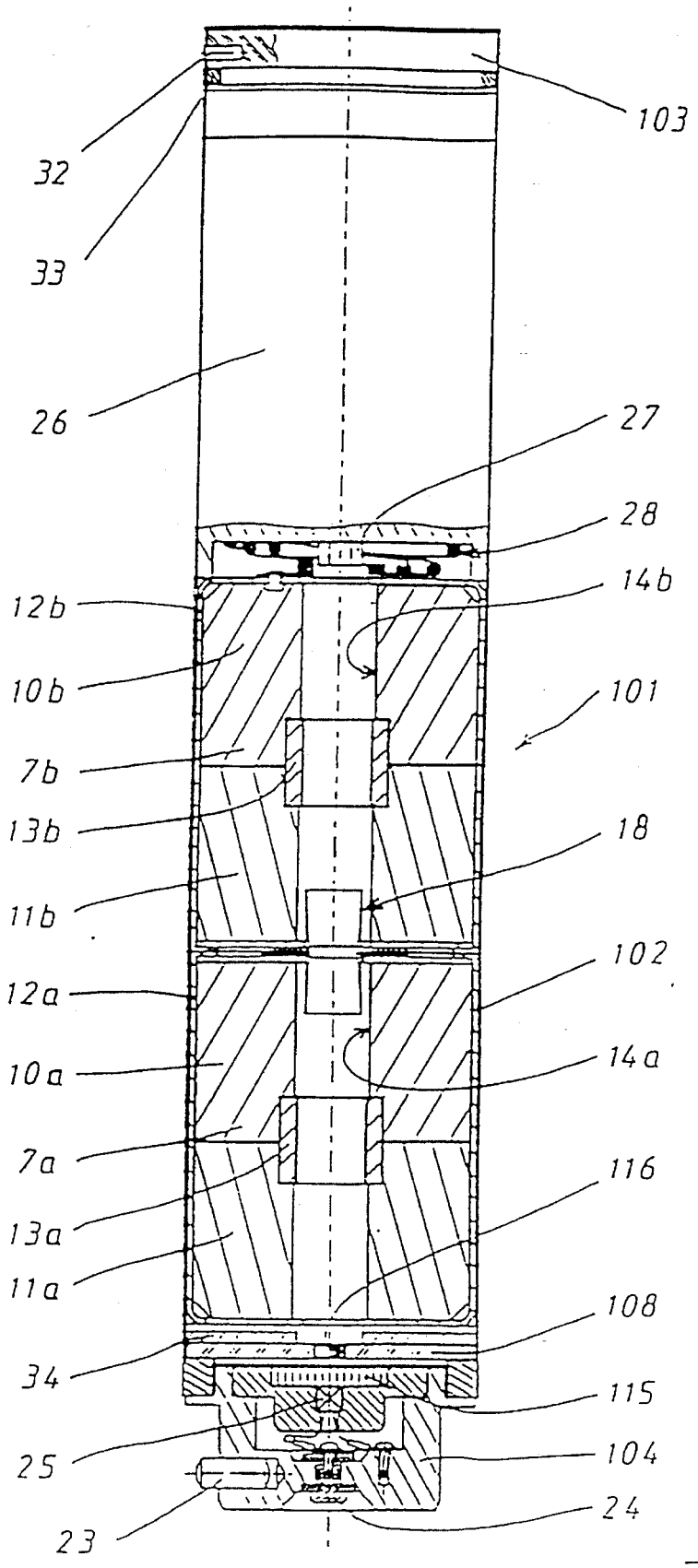
FIG. 2 shows an axial-section view of a smoke-forming munition according to another embodiment of the invention, the munition masking a vehicle with respect to infrared radiation.

FIG. 2 shows another embodiment of the invention, wherein the munition is a smoke-forming munition intended to be attached to a close-in defense system integral with a vehicle or a fixed structure (not shown). Component parts of this munition that are identical to those described above with reference to FIGS. 1 and 4 have the same reference numerals in FIGS. 2—3.

Munition 101 includes cylindrical casing 102, closed at one of its ends by base 104 and at the other end by lid 103. Base 104 is designed to mount munition 102 on a close-in defense launcher of a known type (not shown). Lug 23 locks base 104 onto the launcher, and axial electrical contact 24 is designed to trigger igniter 25. The other electrical contact of igniter 25 is connected to the electrical ground of the launcher through base 104. Electrical contact 24 is insulated electrically from base 104 by an insulating sheath.

Igniter 25 is designed to ignite ejection composition 115, which can be of the black powder type, for example, or a charge of the type described in French Patent Appln. No. 8716763 (French Patent No. 2,624,113). Composition 115 generates gases that apply pressure to piston 108. Piston 108 has an opening 116, which allows some of the gases to pass to two smoke pots 7*a*, 7*b* contained in casing 102. Pots 7*a*, 7*b* are of a smoke-forming pyrotechnic composition and are identical to those described in the previous embodiment.

Casing 102 also contains, forward of the casing in the ejection direction, housing 26, which is filled with a dispersible powder charge intended to provide instant infrared masking. This dispersible powder is, for example, a brass powder and is dispersed by a pyrotechnic composition (not shown), such as a powder or an explosive. The powder is triggered by pyrotechnic fuse 27, itself ignited by the ejection gases of smoke pots 7*a*, 7*b*. The design of such a housing is described in detail in French Patent Appln. No. 8703415.

Figure 3:
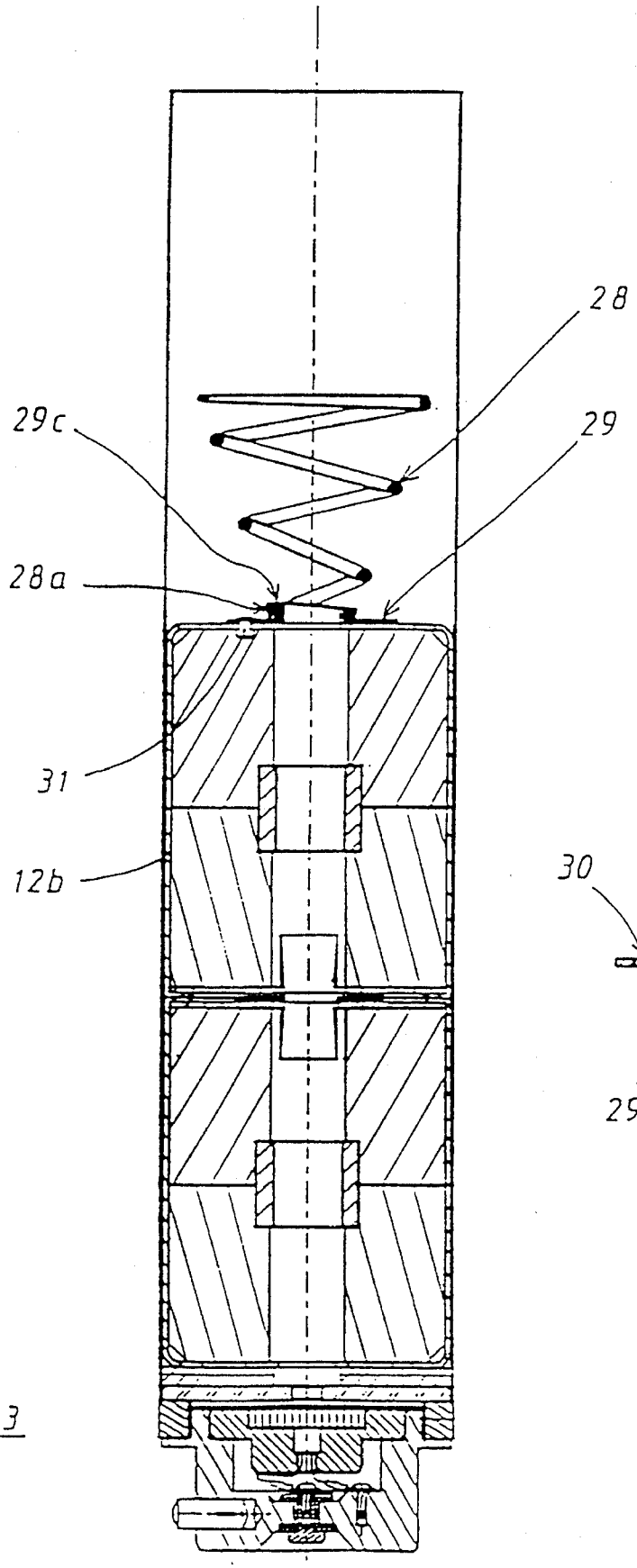
FIG. 3 shows the FIG. 2 munition without the housing containing the dispersible powder charge.

Spring 28, disposed between housing 26 containing the powder charge and smoke pot 7*b*, is designed to separate housing 26 from smoke pots 7*a*, 7*b* when they are ejected outside casing 102. Spring 28 is preferably of the tapered-winding type so that its axial dimension is very small when it is compressed. It is attached at one of its ends 28*a* to smoke pot 7*b* by link 29, as shown in FIG. 3. Spring 28 is shown in the extended position in FIG. 3*a*, which shows munition 101 in FIG. 2 without housing 26.

Figure 4:
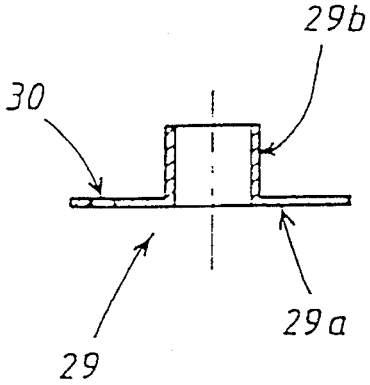
FIG. 4 shows a part that attaches an ejection spring.
Figure 6:
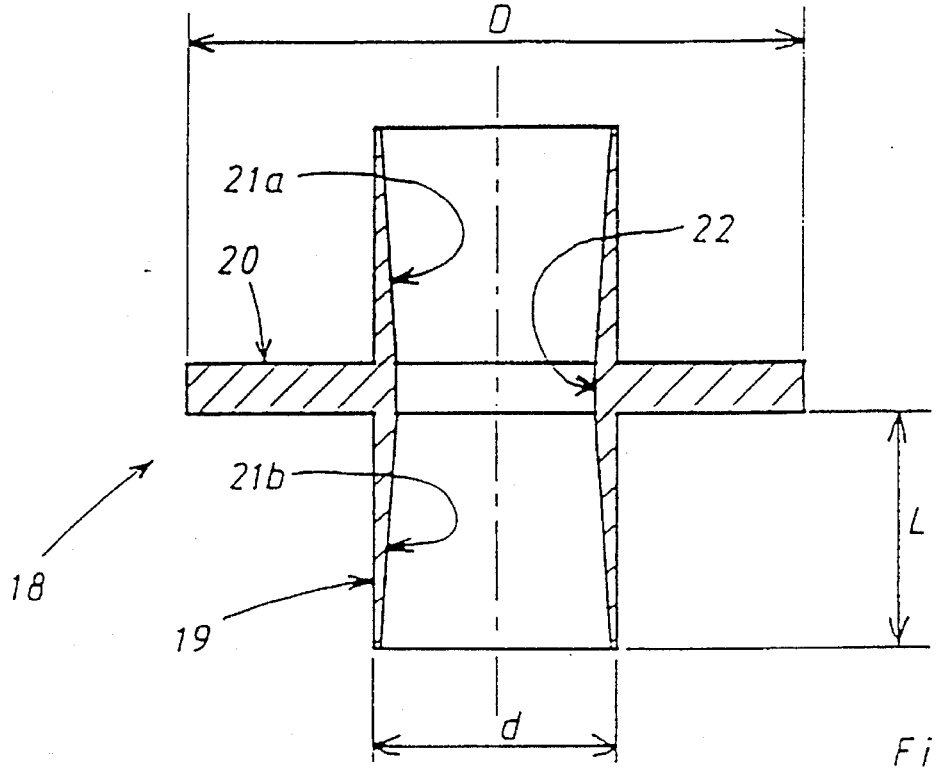
FIG. 6 is a cross-sectional view along line 6—6 of FIG. 5.
Figure 5:
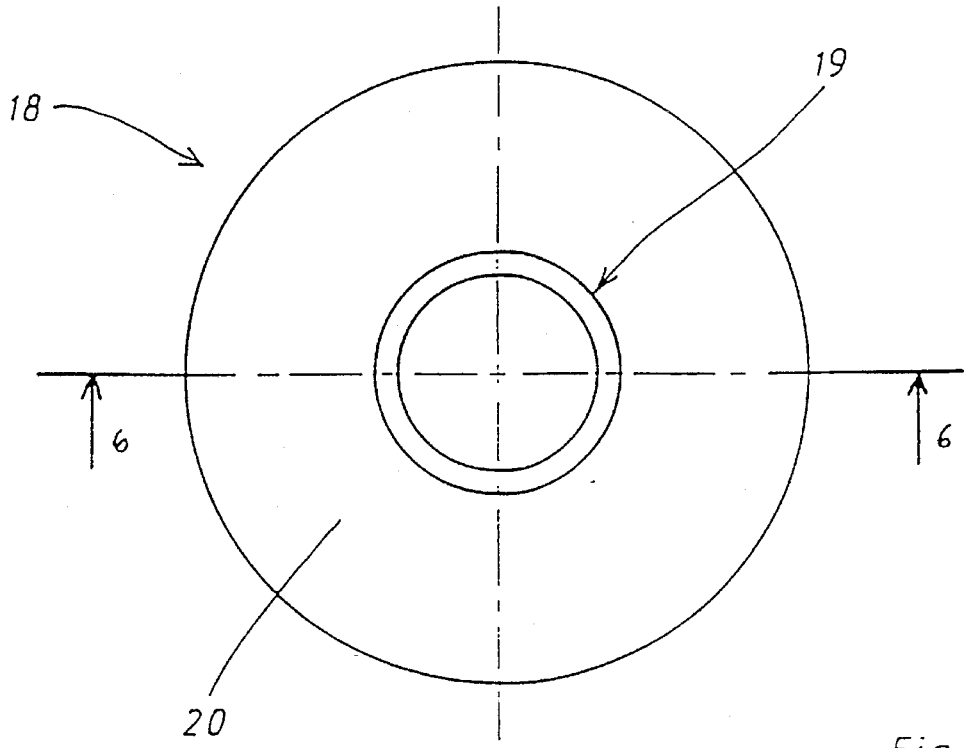
FIG. 5 shows a ring providing an axial link between the smoke pots.

Link 29, shown in greater detail and in axial section in FIG. 4, is a pressed plate. Plane face 29*a* is designed to abut smoke pot 7*b*, and tubular portion 29*b* has an end 29*c* (FIG. 3*a*) crimped onto end 28*a* of spring 28. Link 29 has three holes 30, regularly and angularly spaced, allowing attachment of link 29 to cartridge 12*b* of pot 7*b*, preferably by rivets 31.

The stack constituted by smoke pots 7*a*, 7*b* in housing 26 is held axially in casing 102 by closing lid 103. Lid 103 is attached to casing 102, preferably by radial pins 32. Spacer 33 is disposed between lid 103 and housing 26. Another spacer 34, preferably made of compressible material such as rubber, is fitted between piston 108 and smoke pot 7*a* and takes up play when munition 101 is mounted.

Munition 101 operates as follows:

The close-in defense system provides a firing signal. Igniter 25 then ignites ejection composition 115. The gases generated by ejection composition 115 push piston 108, shearing pins 32 and ejecting the stack of pots 7*a*, 7*b* and housing 26 outside casing 102.

At the same time, the gases pass through opening 116 and flow into the ignition channel composed of the two axial channels 14*a*, 14*b* of pots 7*a*, 7*b*. The gases trigger ignition tablets 13*a*, 13*b*. The gases also ignite pyrotechnic fuse 27, which is designed to trigger the explosive charge that disperses the powder contained in housing 26.

As in the first-described embodiment, ring 18 prevents the gases from penetrating between pots 7*a*, 7*b*. Pots 7*a*, 7*b* are, therefore, ejected together outside casing 102 and stay together in the course of their trajectory.

The ejection of lid 102 releases spring 28. Spring 28 expands, pushing against housing 26 and braking the assembly of pots 7*a*, 7*b* at the same time. The range obtained depends on the masses and inertias of the various elements as well as the mass of ejection composition 115. The spacing obtained between housing 26 and pots 7*a*, 7*b* also depends on the stiffness of the spring. Using a spring to brake smoke pots 7*a*, 7*b* allows the ballistics of pots 7*a*, 7*b* to be easily controlled.

In practice, for a munition caliber of 80 mm, these elements are sized to have smoke pots 7*a*, 7*b* strike the ground or other destination at a distance of approximately 20 meters from the close-in defense system (and, therefore, from the vehicle or the fixed platform on which it is mounted). The pyrotechnic fuse that triggers deployment of the powder charge is chosen such that this deployment occurs at a distance of approximately 20 meters from the close-in defense system.

Ring 18 causes smoke pots 7*a*, 7*b* to stay together until they strike the ground or other destination. The impact with the ground is sufficiently violent to cause pots 7*a*, 7*b* to separate. Even after separation and any rebounding, however, the maximum distance between pots 7*a*, 7*b* will not exceed 15 meters, causing overlap between the smoke screens generated by each pot 7*a*, 7*b*.

While the invention has been with reference to specific embodiments, the description is illustrative and is not to be construed as limiting the scope of the invention. Various modifications and changes may occur to those skilled in the art without departing from the spirit and scope of the invention as defined in the following claims.

What is claimed is:

1. A munition of the smoke-forming type, comprising:

at least two smoke pots disposed in a casing;

an ejection composition for ejecting the smoke pots outside the casing;

an axial channel in each smoke pot, the axial channels being aligned so as to form an ignition channel; and means for temporarily linking the smoke pots while the smoke pots are ejected from the casing and while the smoke pots are on a trajectory.

2. A munition according to claim 1, wherein the ejection composition causes ignition of the smoke pots.

3. A munition according to claim 1, wherein the linking means links the smoke pots in an axial direction of the smoke pots.

4. A munition according to claim 1, wherein the linking means comprises a substantially cylindrical ring disposed within the axial channels of each smoke pot, said ring having an outer diameter smaller than a diameter of the axial channel of each smoke pot.

5. A munition according to claim 4, wherein the smoke pots are disposed within respective cartridges, the cartridges each having a hole within which the ring is tightly fit.

6. A munition according to claim 4, wherein faces of the smoke pots are in mutual contact and wherein the ring comprises a collar pinched between the faces of the smoke pots.

7. A munition according to claim 4, wherein the ring penetrates each axial channel for a length substantially equal to the outer diameter of the ring.

8. A munition according to claim 7, wherein a bore diameter of the ring increases regularly from a median zone of the ring to ends of the ring.

9. A munition according to claim 4, wherein the ring is formed of a natural polymer material.

10. A munition according to claim 4, wherein the ring is formed of a synthetic polymer material.

11. A munition according to claim 1, wherein the smoke pots generate a cloud of smoke opaque to infrared radiation.

12. A munition according to claim 1, further including a housing containing a dispersible powder charge.

13. A munition according to claim 12, wherein the dispersible powder charge masks infrared radiation.

14. A munition according to claim 12, wherein the smoke pots are ejected from the casing in an ejection direction, and wherein the housing is disposed forward of the casing in the ejection direction.

15. A munition according to claim 12, further comprising a spring disposed between the housing and the smoke pots, wherein the spring brakes the smoke pots when the smoke pots are ejected from the casing.

16. A munition according to claim 15, wherein the spring has a tapered shape.

17. A munition according to claim 15, wherein the spring is joined to one of the smoke pots by a link.

18. A smoke-forming munition, comprising:

at least two smoke pots disposed in a casing;

an ejection composition coupled with the smoke pots to eject the smoke pots outside the casing;

an ignition channel formed within the smoke pots; and a temporary link between the smoke pots, the link holding the smoke pots in fixed relationship to each other while the smoke pots are ejected from the casing until the smoke pots strike a destination.

19. A smoke-forming munition according to claim 18, wherein the link comprises a ring having an internal bore, the bore having a constant diameter over a median portion of the ring and having an increasing diameter over portions of the ring extending from the median portion toward ends of the ring.

20. A smoke-forming munition, comprising:

at least two smoke pots within a casing;

an ejection composition coupled with the smoke pots to eject the smoke pots from the casing so that the smoke pots are outside the casing;

an ignition channel formed within the smoke pots;

a temporary link comprising link portions disposed within and engaged with the ignition channel formed within the smoke pots to link the smoke pots together while the smoke pots are in flight on a trajectory outside the casing and to separate the smoke pots without explosive ignition when the smoke pots strike a destination.

* * * * *